US007002092B2

(12) United States Patent
Ichimaru

(10) Patent No.: US 7,002,092 B2
(45) Date of Patent: Feb. 21, 2006

(54) LATCH WITH SWITCH

(75) Inventor: Takahide Ichimaru, Chigasaki (JP)

(73) Assignee: Nifco Inc., Yokohama (JP)

( * ) Notice: Subject to any disclaimer, the term of this patent is extended or adjusted under 35 U.S.C. 154(b) by 0 days.

(21) Appl. No.: 10/963,514

(22) Filed: Oct. 14, 2004

(65) Prior Publication Data

US 2005/0082153 A1 Apr. 21, 2005

(30) Foreign Application Priority Data

Oct. 21, 2003 (JP) ..... 2003-360524

(51) Int. Cl.
*H01H 13/56* (2006.01)

(52) U.S. Cl. ..... 200/523; 200/341

(58) Field of Classification Search ..... 200/520, 200/523–526, 16 C, 417, 422, 424–431, 200/237, 238, 243, 250
See application file for complete search history.

(56) References Cited

U.S. PATENT DOCUMENTS 3,624,330 A * 11/1971 Bognar et al. ..... 200/534
4,080,523 A 3/1978 de Loisy
5,360,954 A * 11/1994 Bruggeman et al. ..... 200/524
5,532,444 A * 7/1996 Bonrath et al. ..... 200/524
5,711,414 A 1/1998 Nishitani et al.
6,288,352 B1 * 9/2001 Fukui et al. ..... 200/435

FOREIGN PATENT DOCUMENTS

EP 0731480 9/1999
JP 7-14062 3/1995

* cited by examiner

*Primary Examiner*—Elvin G. Enad
*Assistant Examiner*—M. Fishman
(74) *Attorney, Agent, or Firm*—Manabu Kanesaka

(57) ABSTRACT

In a latch with a switch, when a movable member is pushed into a housing against a force of a coil spring, the movable member is locked in a pushed-in position by a lock mechanism and a switch is turned on. When the movable member is pushed again into the housing, the movable member is returned to a protruding position and the switch is turned off. The switch is formed of a pin attached to the movable member and having both ends protruding from two opposite sides of the movable member; and a pair of fixed terminals fixed inside the housing. When the movable member is at the protruding position, both ends of the pin become a conducting state, and when the movable member is at the pushed-in position, both ends of the pin become a non-conducting state. The conducting and non-conducting states can be reversed.

6 Claims, 12 Drawing Sheets

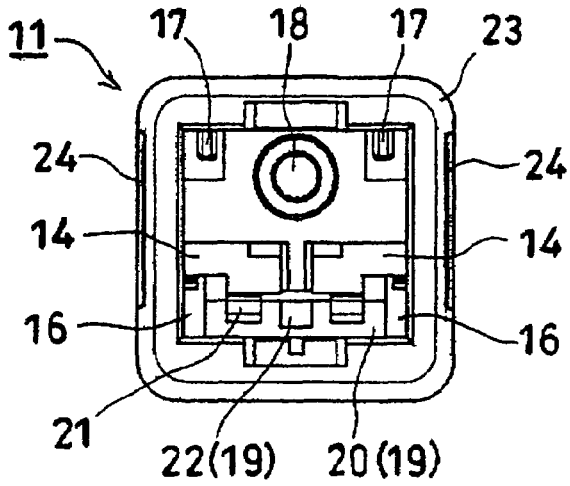
Fig. 7
Fig. 8
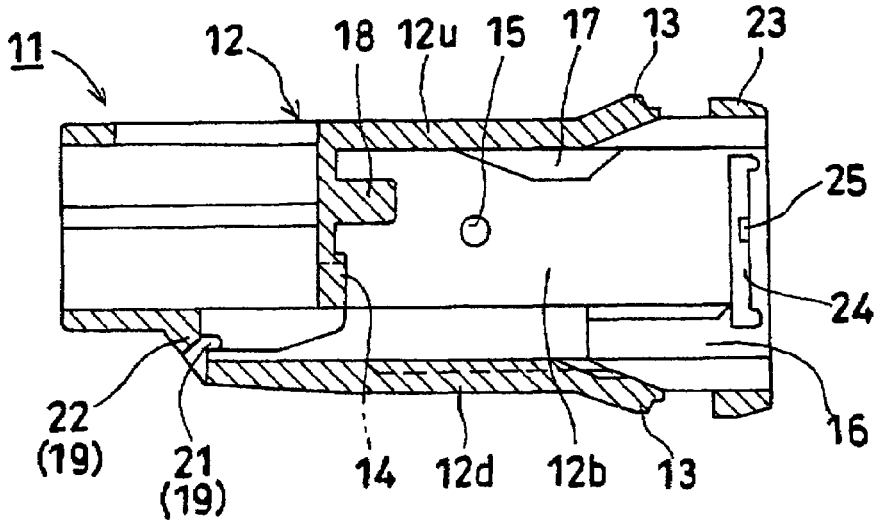
Fig. 9
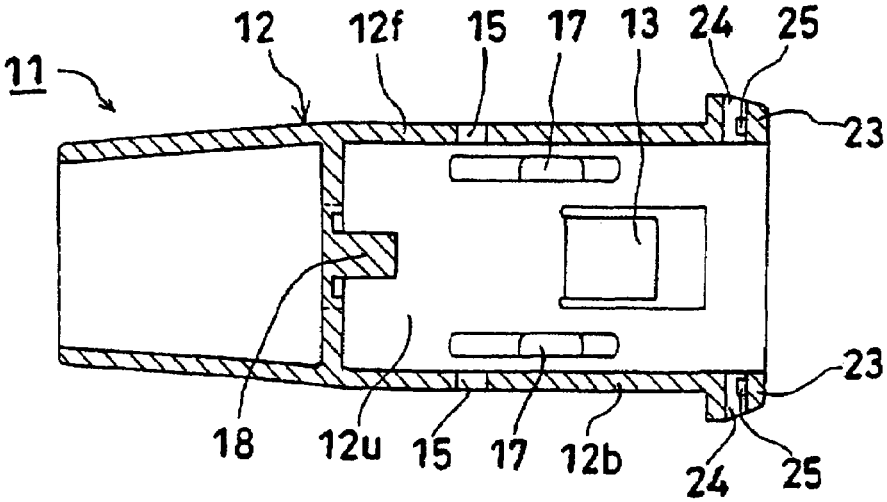

LATCH WITH SWITCH

BACKGROUND OF THE INVENTION AND RELATED ART STATEMENT

The invention relates to a latch with a switch, wherein the switch is provided on the latch attached to an attachment receiving member such as a main body, so that an opening and closing member such as a door of a radio cassette player is pushed to close, and the opening and closing member is pushed again to open.

A conventional latch with a switch is constituted such that, by pushing a movable member forced by a forcing member to a position where a part thereof protrudes from a housing into a housing against a force of the forcing member, a push-push type lock mechanism becomes a locked state, and the movable member is locked in a pushed-in position and the switch is turned on; and by pushing the movable member in the pushed-in position into the housing against the force of the forcing member, the lock mechanism becomes an unlocked state, and the movable member is returned to the protruding position by the force of the forcing member and the switch is turned off.

Patent Document 1: Japanese Utility Model Publication (Kokai) No. 07-14062

The above-mentioned latch with a switch is formed of a fixed terminal fixed to a housing, and a brush-shaped elastic movable terminal contacting and moving away from the fixed terminal, and also sliding relative to the fixed terminal. Because the movable terminal is manufactured by applying a cutting process and bending process to a thin metal plate, it becomes expensive (cost up). Accordingly, the latch with a switch becomes expensive.

An object of the invention is to provide a latch with a switch, wherein by forming a movable terminal as a pin, the movable terminal can be manufactured inexpensively, and the movable terminal is made easier to assemble.

SUMMARY OF THE INVENTION

The invention has the following features:

(1) In a latch with a switch, when a movable member forced by a forcing member to a position where a part thereof protrudes from a housing is pushed into the housing against the force of the forcing member, a push-push type lock mechanism becomes a locked state, and the movable member is locked in a pushed-in position and the switch is turned on or off. When the movable member in the pushed-in position is pushed into the housing against the force of the forcing member, the lock mechanism becomes an unlocked state, and the movable member is returned to the protruding position by the force of the forcing member, and the switch is turned off or on. It is characterized in that: the switch is formed of a movable terminal comprising a pin attached to the movable member and having both ends protruding from two opposite side surfaces of the movable member; and a pair of fixed terminals fixed oppositely inside the housing, and when the movable member is in the protruding position, the both ends of the movable terminal do not contact in a non-conducting state or contact in a conducting state, and when the movable member is in the pushed-in position, the both ends of the movable member contact in the conducting state or do not contact in the non-conducting state. The movable terminal is incorporated from a movable terminal insertion through hole provided in a side surface of the housing.

(2) In the latch with a switch in (1), it is characterized in that the movable terminal is capable of rotating relative to the movable member.

(3) In the latch with a switch in (1) or (2), it is characterized in that a cross-section of the movable terminal is circular.

According to the invention, the switch is formed of the movable terminal comprising the pin attached to the movable member and having the both ends protruding from the two opposite side surfaces of the movable member, and the pair of the fixed terminals fixed oppositely inside the housing, and when the movable member is in the protruding position, the both ends of the movable terminal do not contact in the non-conducting state or contact in the conducting state, and when the movable member is in the pushed-in position, the both ends of the movable member contact in the conducting state or do not contact in the non-conducting state. Accordingly, the movable terminal can be manufactured inexpensively, whereby the latch with a switch can be manufactured inexpensively. Also, the movable terminal is always forced by the forcing member toward a direction of protruding from the housing, and contacts the fixed terminals in the forced state. Accordingly, it is possible to prevent poor contact between the movable terminal and the fixed terminals, thereby improving reliability of the switch.

Also, it is arranged such that the movable terminal is incorporated from the movable terminal insertion through hole provided in the side surface of the housing. Accordingly, the movable terminal becomes easier to assemble, and the assembly operation can be performed with good operating characteristics.

Also, the movable terminal is capable of rotation relative to the movable member. Accordingly, the movable terminal contacts the pair of the fixed terminals at various parts thereof, thereby improving reliability of the switch.

Furthermore, the cross-section of the movable terminal is made circular. Accordingly, a state of contact between the fixed terminals and the movable terminal becomes stable, thereby improving reliability of the switch.

BRIEF DESCRIPTION OF THE DRAWINGS

FIG. 7 is a right side view of the housing shown in FIG. 3;

FIG. 8 is a sectional view taken along line 8—8 in FIG. 4;

FIG. 9 is a sectional view taken along line 9—9 in FIG. 5;

DETAILED DESCRIPTION OF PREFERRED EMBODIMENTS

Figure 1:
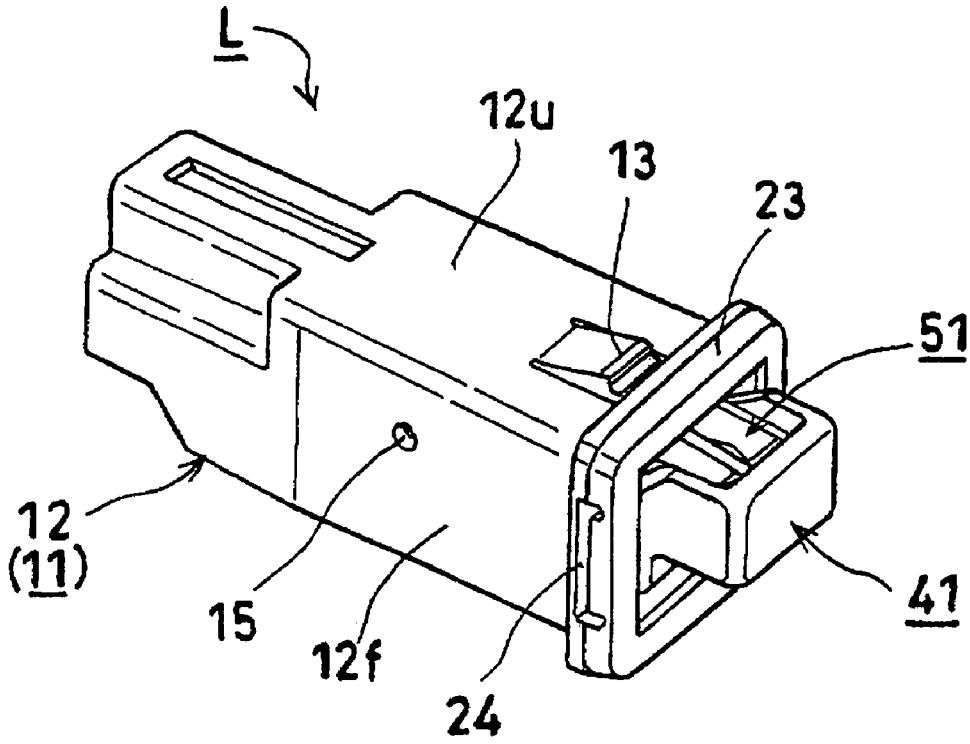
FIG. 1 is a perspective view seen from a front of a latch with a switch according to a first embodiment of the invention.
Figure 2:
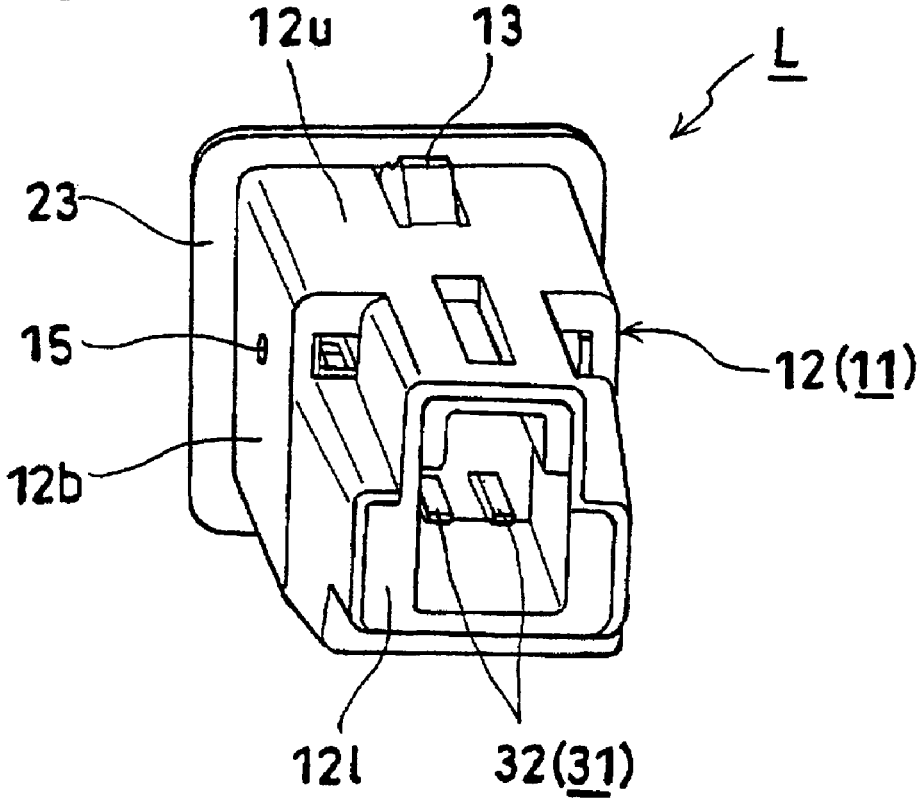
FIG. 2 is a perspective view seen from a back of the latch with a switch shown in FIG. 1.
Figure 3:
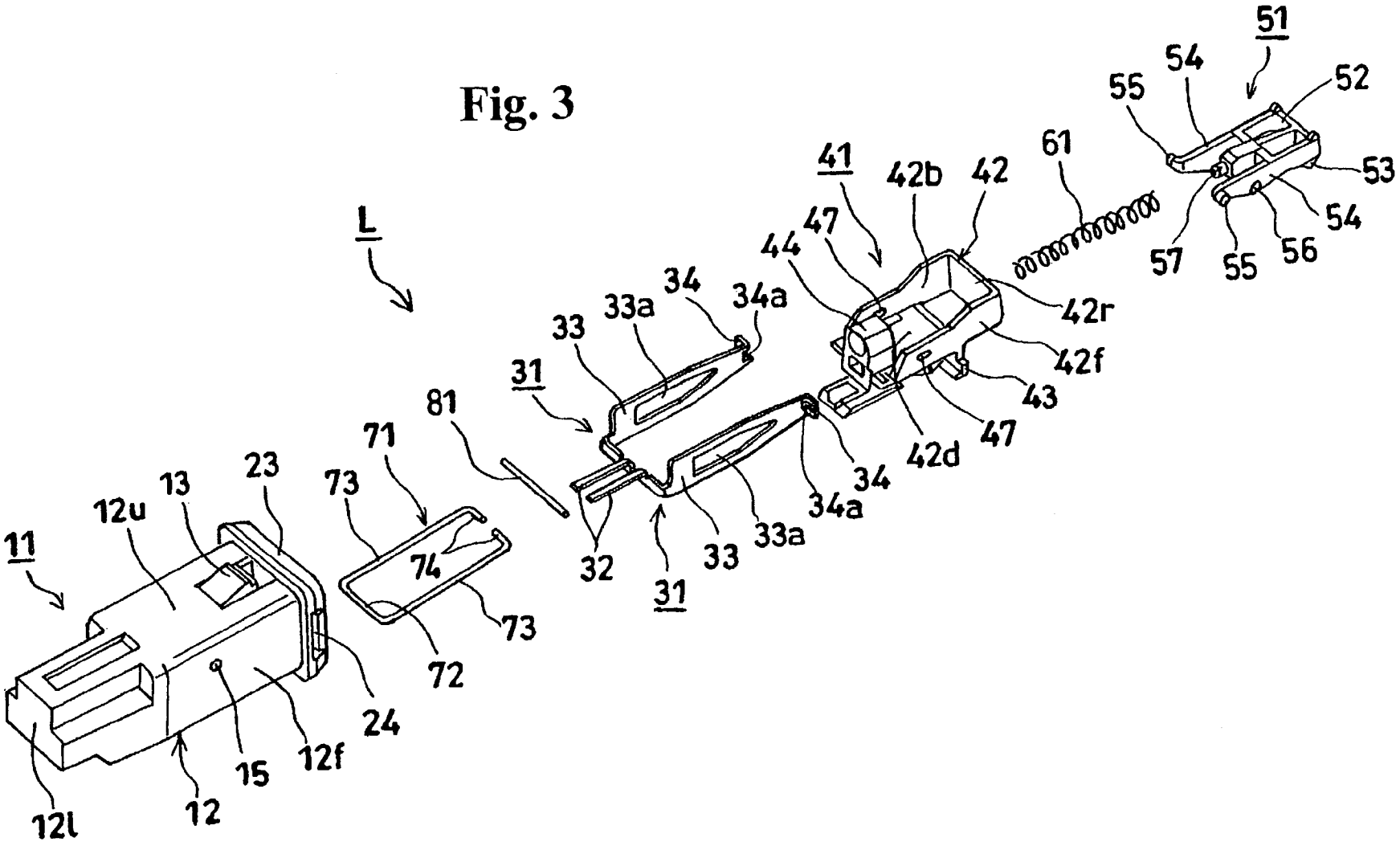
FIG. 3 is an exploded perspective view of the latch with a switch shown in FIG. 1 and FIG. 2.

FIG. 1 is a perspective view seen from a front of a latch with a switch according to a first embodiment of the invention. FIG. 2 is a perspective view seen from a back of the latch with a switch shown in FIG. 1. FIG. 3 is an exploded perspective view of the latch with a switch shown in FIG. 1 and FIG. 2.

In these drawings, symbol L indicates the latch with a switch. The latch is formed of a box-like housing 11 with one open side surface (right side surface); a pair of fixed terminals 31 fixed inside the housing 11; a movable member 41 inserted into the housing 11; a checking member 51 attached to the movable member 41 to be capable of rotating; a coil spring 61 placed between the checking member 51 and the housing 11 as a forcing member for urging the movable member 41 toward a direction of protruding from the housing 11 via the checking member 51; a guide lever 71 attached to the housing 11; and a pin 81 as a movable terminal with a circular cross-section attached to the movable member 41 as a rotating support shaft of the checking member 51 for contacting and moving away from the fixed terminals 31.

Figure 4:
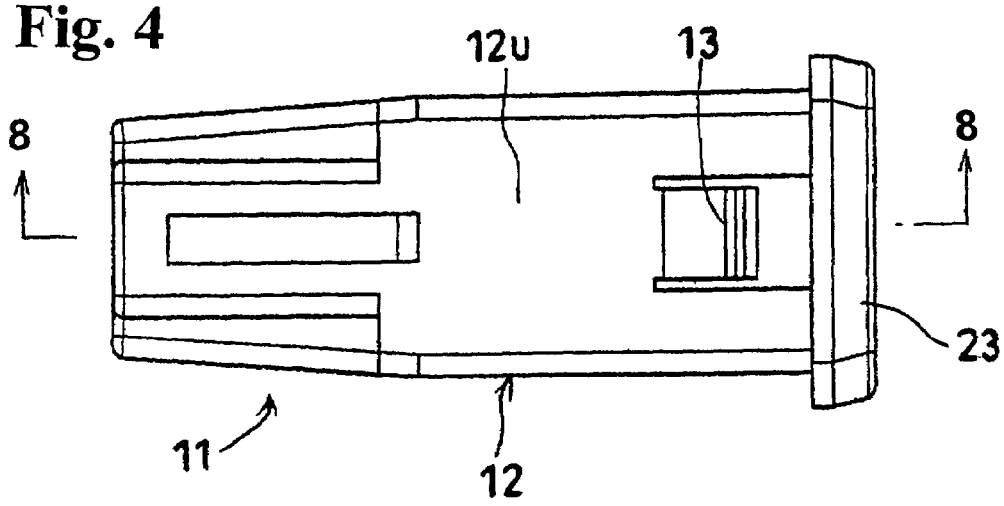
FIG. 4 is a plan view of a housing shown in FIG. 3.
Figure 5:
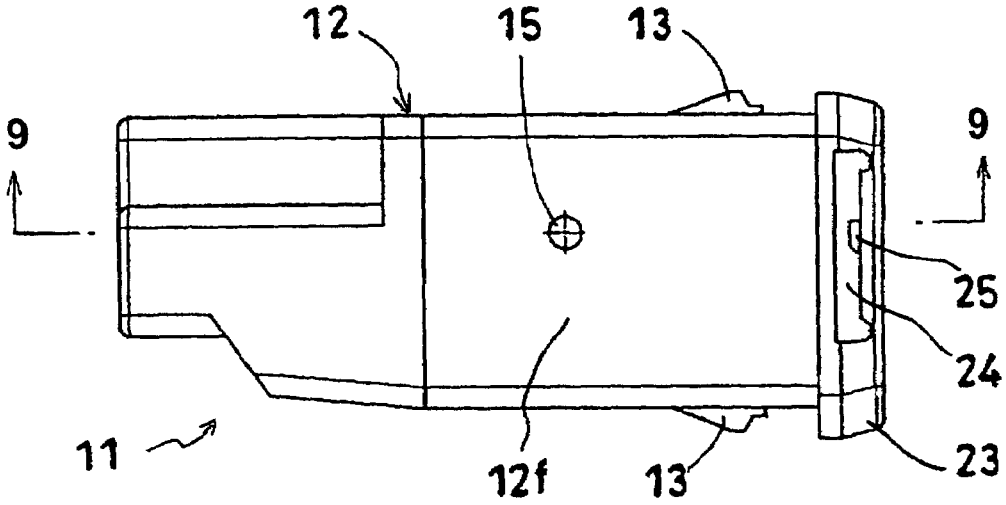
FIG. 5 is a front view of the housing shown in FIG. 3.
Figure 6:
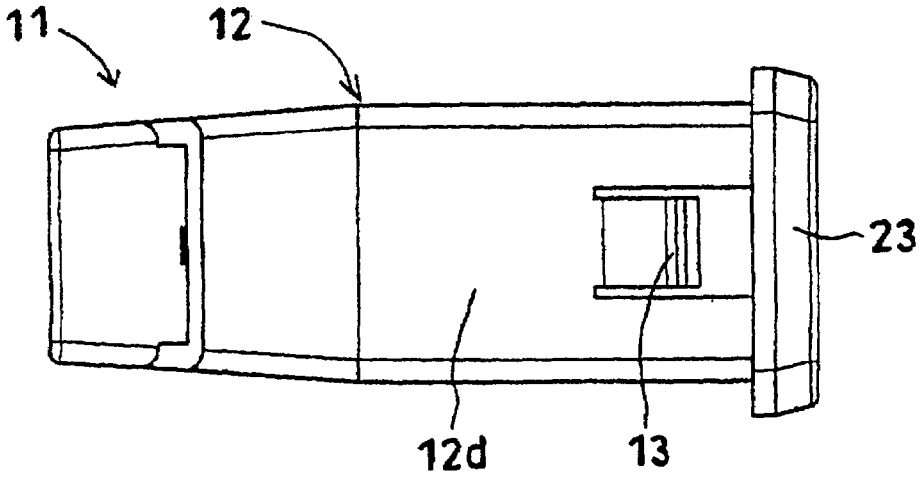
FIG. 6 is a bottom view of the housing shown in FIG. 3.

FIG. 4 is a plan view of the housing shown in FIG. 3, FIG. 5 is a front view of the housing shown in FIG. 3, FIG. 6 is a bottom view of the housing shown in FIG. 3, FIG. 7 is a right side view of the housing shown in FIG. 3, FIG. 8 is a sectional view taken along line 8—8 in FIG. 4, and FIG. 9 is a sectional view taken along line 9—9 in FIG. 5. Incidentally, in the following explanation, up and down, left and right, and front and back are those in the front views of each member.

In these drawings, the housing 11 formed of a molded synthetic resin includes a box part 12 comprising a front wall 12*f*, back wall 12*b*, top wall 12*u*, bottom wall 12*d*, and left side wall 12*l*; and a frame part 23 with a rectangular shape viewed from the right side connected to a right side of the box part 12 and projecting outwardly around the box part 12 on front, back, upper and lower sides thereof, so that a right side surface (right side wall: one end surface) becomes an opening. A left side of the top wall 12*u* on the front wall 12*f* side and the back wall 12*b* side extends downwardly in a vertical direction about, for example, ⅓ of a height of the front wall 12*f* and the back wall 12*b*, upwardly with an angle for ¼, and then horizontally. Also, a left side of the bottom wall 12*d* extends upwardly with an angle from right to left about, for example, ¼ of the height of the front wall 12*f* and the back wall 12*b*, and then horizontally.

Also, on the box part 12, elastic gripping pieces 13 extending from the left side wall 121 side to the right (frame part 23) side are provided on the top wall 12*u* and the bottom wall 12*d* at the frame part 23 side for gripping an attachment receiving member together with the frame part 23, respectively. Terminal insertion holes 14 are provided in the left side wall 121 at the front wall 12*f* side and the back wall 12*b* side for inserting left ends of the fixed terminals 31, respectively. Movable terminal insertion through holes 15 are provided at the same positions in the front wall 12*f* and the back wall 12*b* for inserting the pin 81, respectively.

Furthermore, on the box part 12, guide slots 16 are provided horizontally in lower parts inside of the front wall 12*f* and the back wall 12*b* for guiding guided parts 43 of the movable member 41, respectively. Cam projections 17 are provided on the top wall 12*u* at the front wall 12*f* side and the back wall 12*b* side for causing the checking member 51 to rotate, respectively. Also, on the box part 12, on the inside of the dropping-down part of the top wall 12*u*, a spring bearing 18 is provided horizontally on the frame part 23 side for positioning the coil spring 61.

Furthermore, on the box part 12, guide lever attachment parts 19 are provided for attaching the guide lever 71. The guide lever attachment parts 19 comprise insertion holes 20 for inserting arm parts 73 and trace parts 74 of the guide lever 71; recessed parts 21 for positioning the guide lever 71 to be rotatable; and an elastic pressing piece 22 for pressing a shaft part 72 of the guide lever 71 into the recessed parts 21 to be rotatable, which are provided on a sloping part of the bottom wall 12*d*.

Also, on the frame part 23, rectangular terminal insertion holes 24 with a flat shape extending in the vertical direction for inserting right ends of the fixed terminals 31, and checking projections 25 entering coupling holes 34*a* of the fixed terminals 31 inserted into the terminal insertion holes 24 to restrict a movement of the fixed terminals 31 are provided at portions corresponding to the front wall 12*f* and the back wall 12*b* of the box part 12. The positions of the movable terminal insertion through holes 15 are provided in correspondence with movable terminal insertion holes 47 of the movable member 41 and movable terminal insertion holes 56 of the checking member 51.

Figure 10:
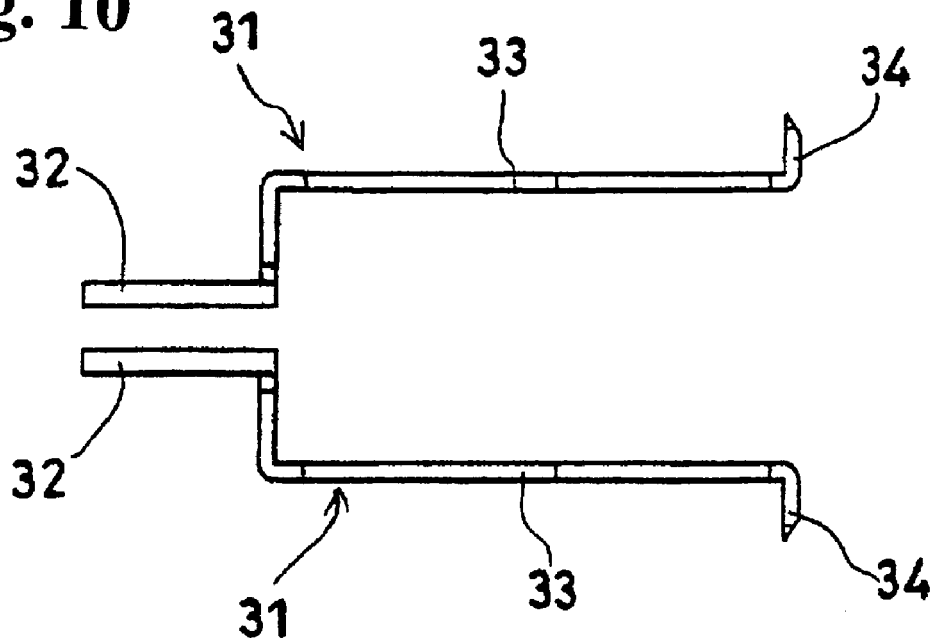
FIG. 10 is a plan view of fixed terminals shown in FIG. 3.
Figure 11:
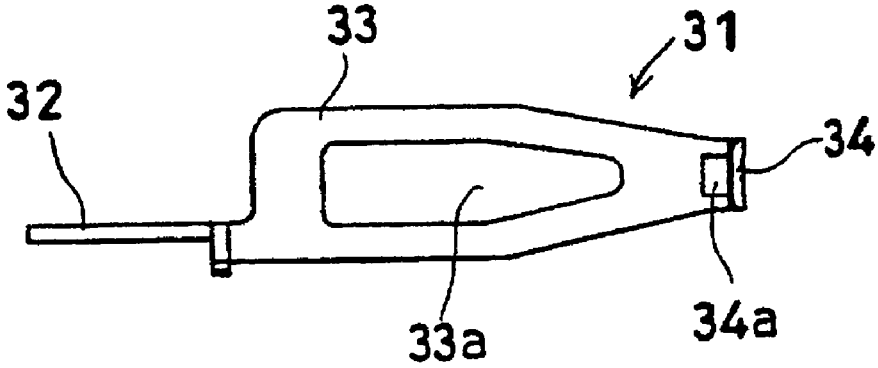
FIG. 11 is a front view of the fixed terminals shown in FIG. 3.
Figure 12:
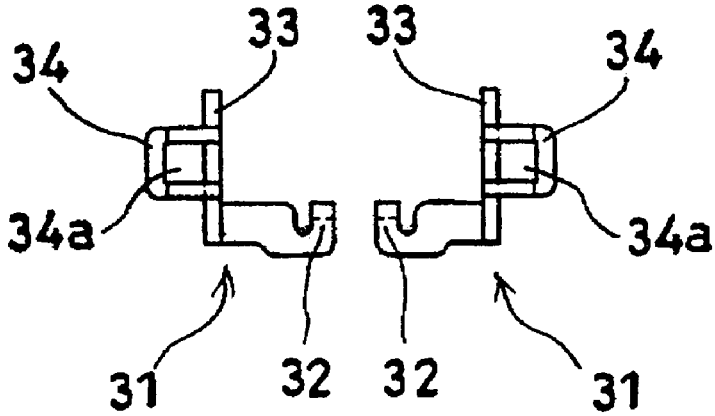
FIG. 12 is a right side view of the fixed terminals shown in FIG. 3.

FIG. 10 is a plan view of the fixed terminals shown in FIG. 3, FIG. 11 is a front view of the fixed terminals shown in FIG. 3, and FIG. 12 is a right side view of the fixed terminals shown in FIG. 3.

In these drawings, reference numeral 31 indicates the fixed terminal formed by pressing a conductive metal plate. The fixed terminal 31 is formed of a connection part 32 with a left end part bent at a right angle to protrude out of the housing 11 from the terminal insertion hole 14 of the housing 11; a flat plate part 33 connected to the connection part 32 like a crank; and a coupling part 34 bent at a right angle and connected to a right end of the flat plate part 33 to be inserted into the terminal insertion holes 24 of the housing 11. A pair of the fixed terminals 31 is formed symmetrically on the horizontal plane held between the fixed terminals 31, as shown in FIG. 10.

Also, a terminal hole 33*a* is provided in the flat plate part 33 as a cut-out, so that the pin 81 contacts and moves away from an edge thereof. Also, on the coupling part 34, a coupling hole 34*a* is provided extending up to a right end part of the flat plate part 33 for a checking projection 25 of the housing 11 to engage an edge thereof. The terminal hole 33*a* has a shape in which an isosceles triangle having a rounded vertex is connected to a right side of a horizontally long rectangle. A right side of the rectangle of the terminal hole 33*a* has a length same as a base length of the isosceles triangle.

Figure 13:
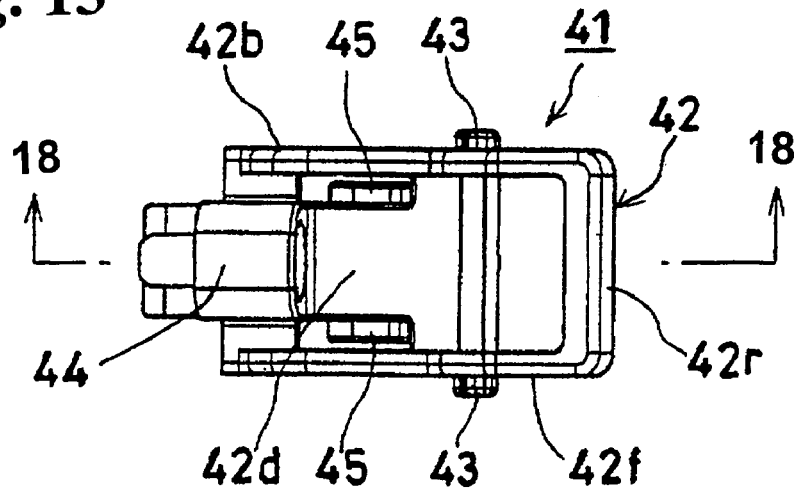
FIG. 13 is a plan view of a movable member shown in FIG. 3.
Figure 14:
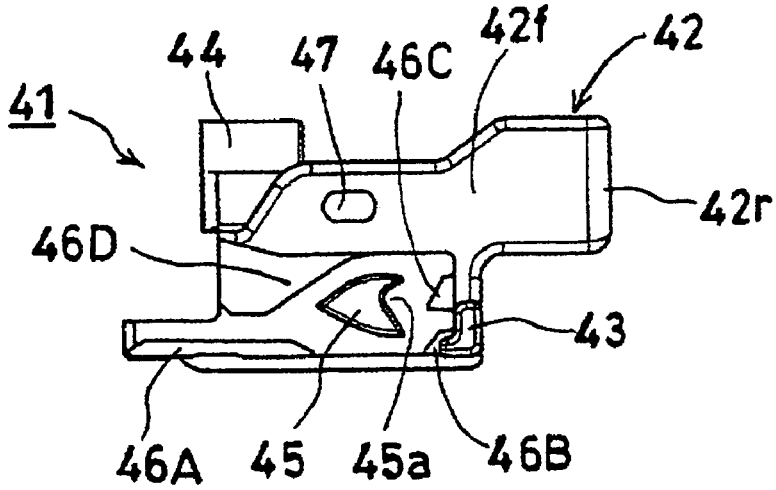
FIG. 14 is a front view of the movable member shown in FIG. 3.
Figure 15:
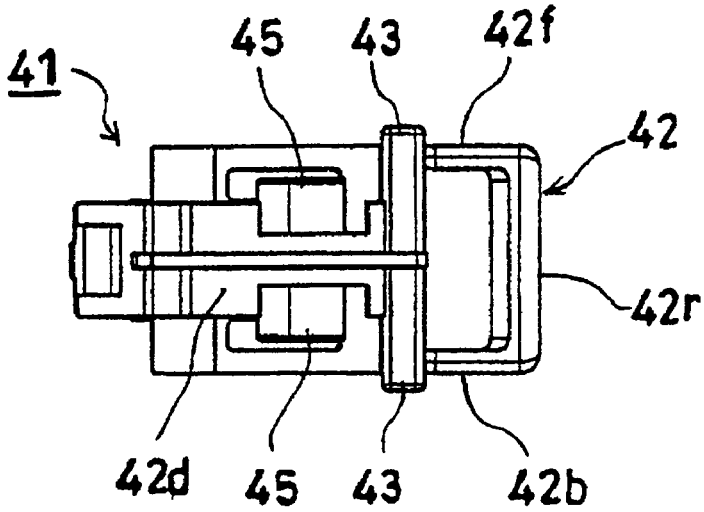
FIG. 15 is a bottom view of the movable member shown in FIG. 3.
Figure 16:
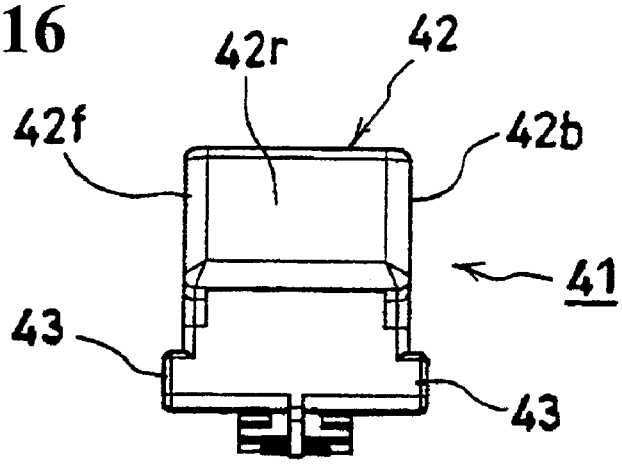
FIG. 16 is a right side view of the movable member shown in FIG. 3.
Figure 17:
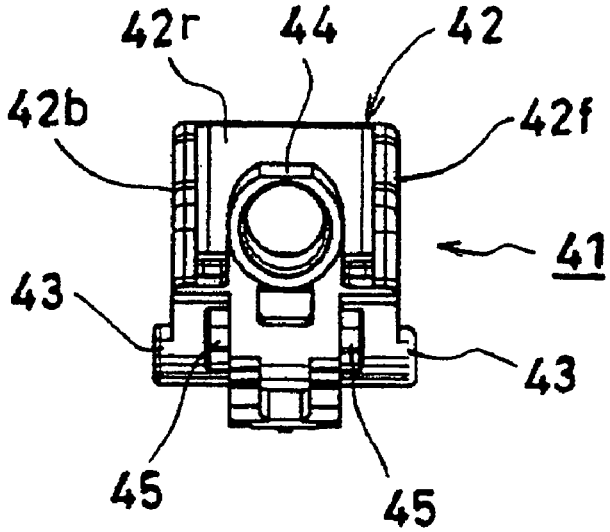
FIG. 17 is a left side view of the movable member shown in FIG. 3.
Figure 18:
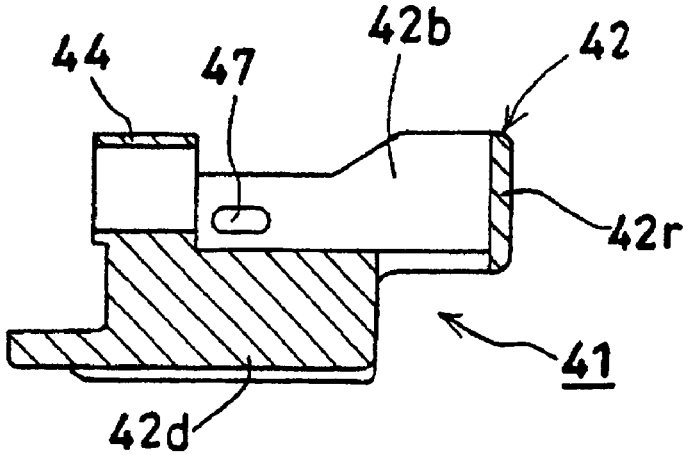
FIG. 18 is a sectional view taken along line 18—18 in FIG. 13.

FIG. 13 is a plan view of the movable member shown in FIG. 3, FIG. 14 is a front view of the movable member shown in FIG. 3, FIG. 15 is a bottom view of the movable member shown in FIG. 3, FIG. 16 is a right side view of the movable member shown in FIG. 3, FIG. 17 is a left side view of the movable member shown in FIG. 3, and FIG. 18 is a sectional view taken along line 18—18 in FIG. 13.

In these drawings, reference numeral 41 indicates the movable member formed of a molded synthetic resin. The movable member is formed of an open box part 42 with a front wall 42*f*, back wall 42*b*, bottom wall 42*d*, and right side wall 42*r*, so that an upper surface and a left side surface become open. Lower right ends of the front wall 42*f*, back wall 42*b*, and right side wall 42*r* are cut-out in a rectangular shape. Also, on the movable member 41, guided parts 43 protruding outwardly from the front wall 42*f* and the back wall 42*b* to be guided by the guide slots 16 of the housing 11 are provided on outer surfaces of the lower right ends of the front wall 42*f* and the back wall 42*b*, and a coil spring holding part 44 is provided on an upper surface of a left side of the bottom wall 42*d* for holding a right side of the coil spring 61 so as not to buckle.

Furthermore, on the movable member 41, heart cams 45 having cam recessed parts 45*a* for engaging the trace parts 74 of the guide lever 71; first cams 46A and second cams 46B for guiding the trace parts 74 of the guide levers 71 so as to engage the cam recessed parts 45*a* of the heart cams 45 from a state in which they do not engage the cam recessed parts 45*a* of the heart cams 45; and third cams 46C and fourth cams 46D for guiding the trace parts 74 of the guide levers 71 engaging the cam recessed parts 45*a* of the heart cams 45 to the original state (state in which they do not engage the cam recessed parts 45*a* of the heart cams 45) are provided on lower sides of the bottom wall 42*d* toward a front side and a back side. Also, on the movable member 41, movable terminal insertion holes 47 with a shape elongated left to right are provided in the front wall 42*f* and the back wall 42*b* for inserting the pin 81 in correspondence with the movable terminal insertion through holes 15 of the housing 11.

Figure 19:
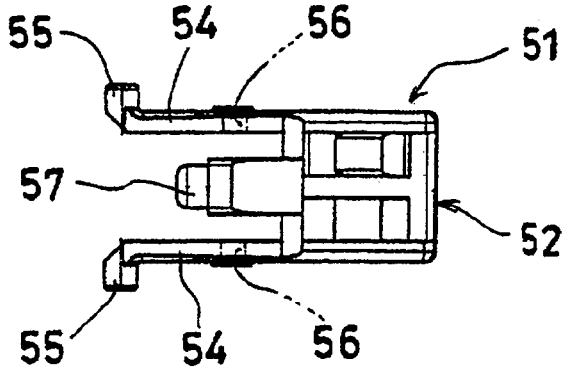
FIG. 19 is a plan view of a checking member shown in FIG. 3.
Figure 20:
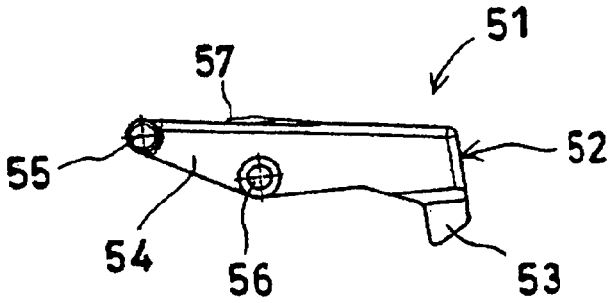
FIG. 20 is a front view of the checking member shown in FIG. 3.
Figure 21:
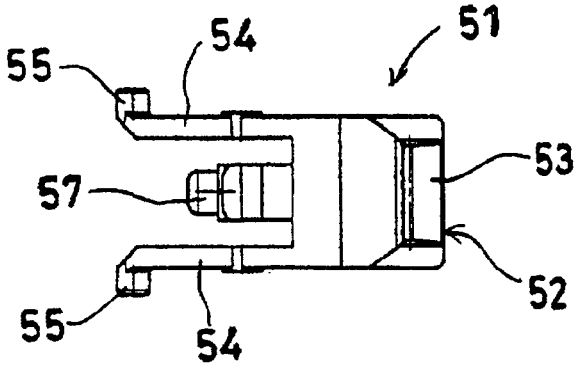
FIG. 21 is a bottom view of the checking member shown in FIG. 3.
Figure 22:
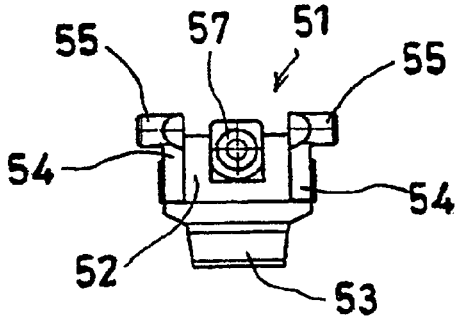
FIG. 22 is a left side view of the checking member shown in FIG. 3.

FIG. 19 is a plan view of the checking member shown in FIG. 3, FIG. 20 is a front view of the checking member shown in FIG. 3, FIG. 21 is a bottom view of the checking member shown in FIG. 3, and FIG. 22 is a left side view of the checking member shown in FIG. 3.

In these drawings, reference numeral 51 indicates the checking member formed of a molded synthetic resin. The checking member is formed of a main body 52; a checking part 53 provided protruding on a front end of a lower side of the main body 52 for engaging a coupling part t of a striker S (described later); elastic leg parts 54 extending in parallel toward the left from front and back left ends of the main body 52; trace parts 55 provided on outsides (front and back) of left ends of the elastic leg parts 54 for moving along the cam projections 17 of the housing 11; movable terminal insertion holes 56 provided in right sides of the elastic leg parts 54 from a center in the left-right direction for inserting the pin 81 and corresponding to the movable terminal insertion holes 15 of the housing 11 and the movable terminal insertion through holes 47 of the movable member 41; and a spring bearing 57 extending toward the left side from a center part in the front-back direction on the left end of the main body 52 for positioning a right end of the coil spring 61.

The spring bearing 57 is provided above the pair of movable terminal insertion holes 56. Accordingly, the checking member 51 always is forced to rotate in the clockwise direction viewed from the front by the coil spring 61, and the trace parts 55 contact the cam projections 17 of the housing 11.

In FIG. 3, reference numeral 71 indicates the guide lever made by bending a metal bar into a bracket shape viewed on a plane so that arm parts 73 extend in parallel to the right side from a front end and back end of a shaft part 72 extending horizontally in the front-back direction, and by bending open end parts of the two arm parts 73 respectively inward so as to be guided by the heart cams 45 and the first-fourth cams 46A–46D of the movable member 41 as trace parts 74.

In FIG. 3, reference numeral 81 indicates a pin as the movable terminal. The pin 81 is formed of a conductive metal bar with a circular cross section coated with conductive plating, and has a length longer than a length of the movable member 41 in the front-back direction and slightly shorter than a distance between the outsides of the fixed terminals 31 placed inside the housing 11 in the front-back direction. Also, the pin 81 is rotatably attached to the movable terminal insertion holes 47 of the movable member 41 and the movable terminal insertion holes 56 of the checking member 51.

In the latch L with a switch of the first embodiment, the switch is formed of the pair of fixed terminals 31 and the pin 81. Also, the lock mechanism is formed of the heart cams 45 and first-fourth cams 46A–46D of the movable member 41, and the guide lever 71.

Figure 23:
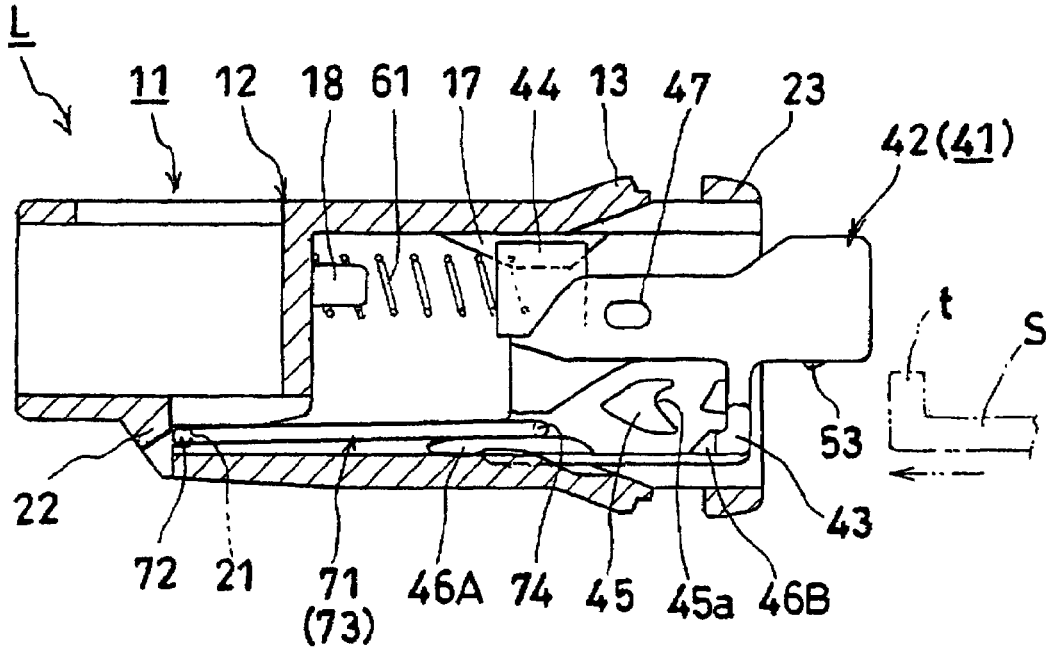
FIG. 23 is an explanatory drawing of an operation of the latch with a switch according to the first embodiment of the invention.
Figure 24:
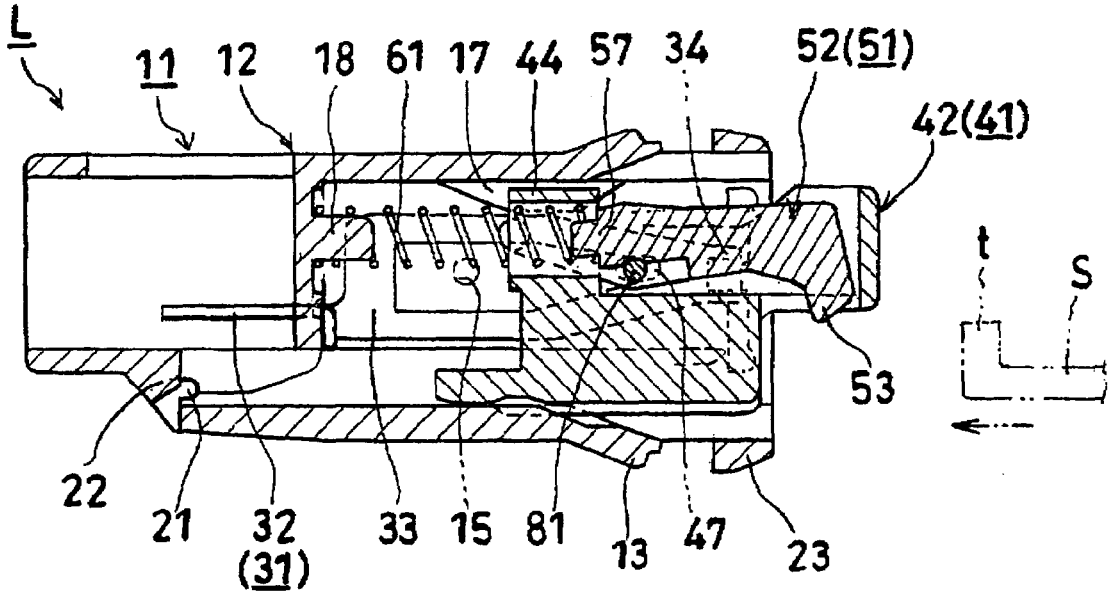
FIG. 24 is an explanatory drawing of the operation of the latch with a switch according to the first embodiment of the invention.
Figure 25:
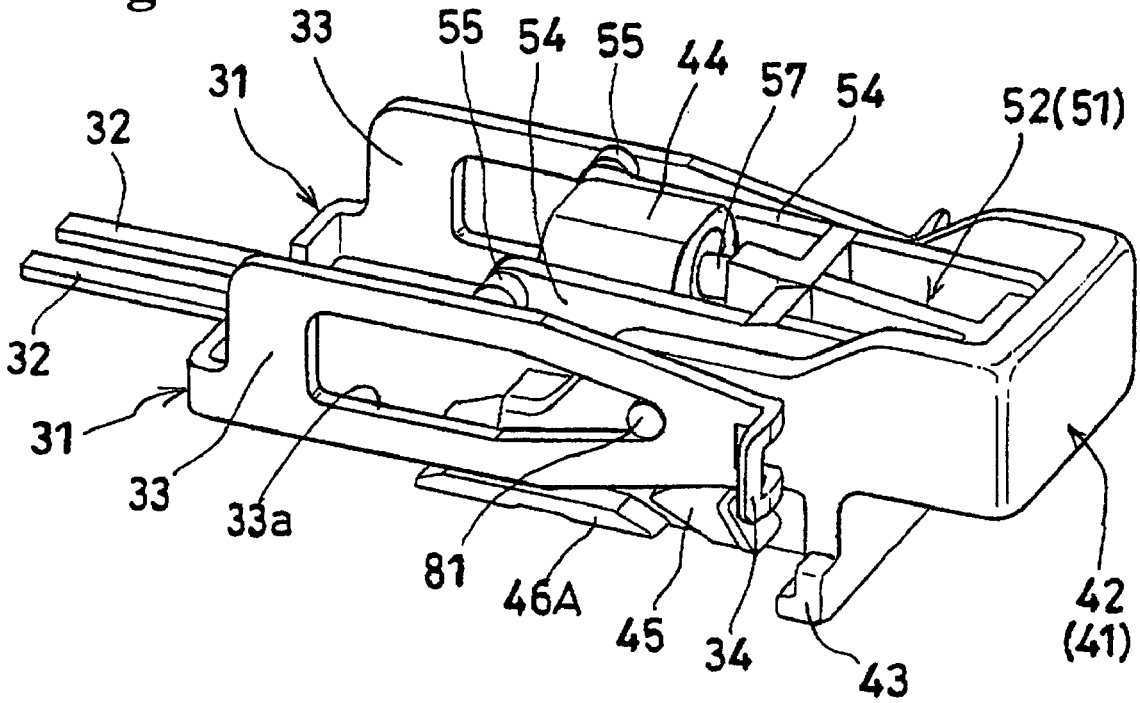
FIG. 25 is an explanatory drawing of the operation of the latch with a switch according to the first embodiment of the invention.
Figure 26:
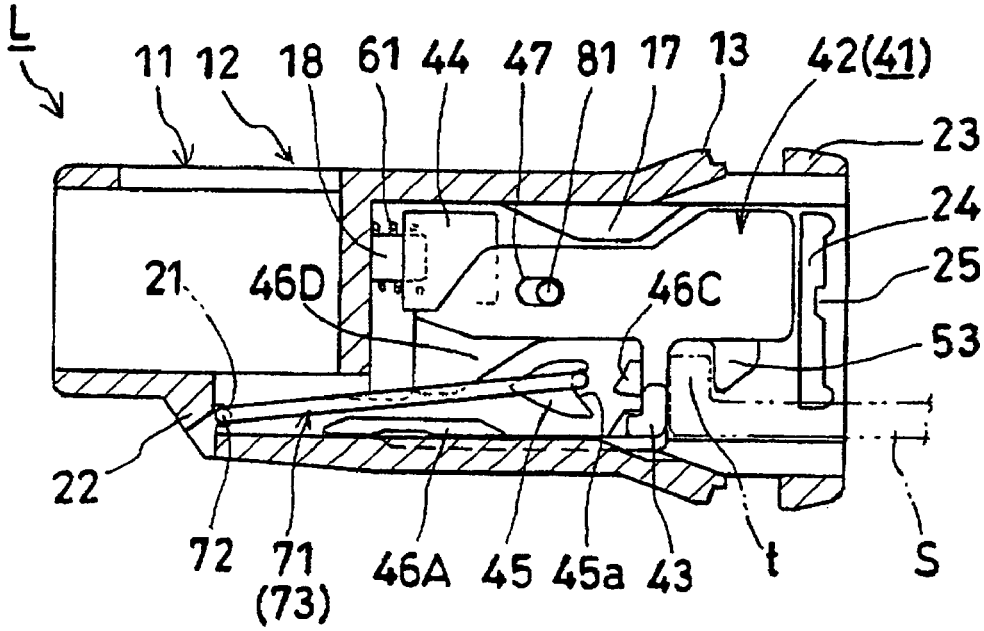
FIG. 26 is an explanatory drawing of the operation of the latch with a switch according to the first embodiment of the invention.
Figure 27:
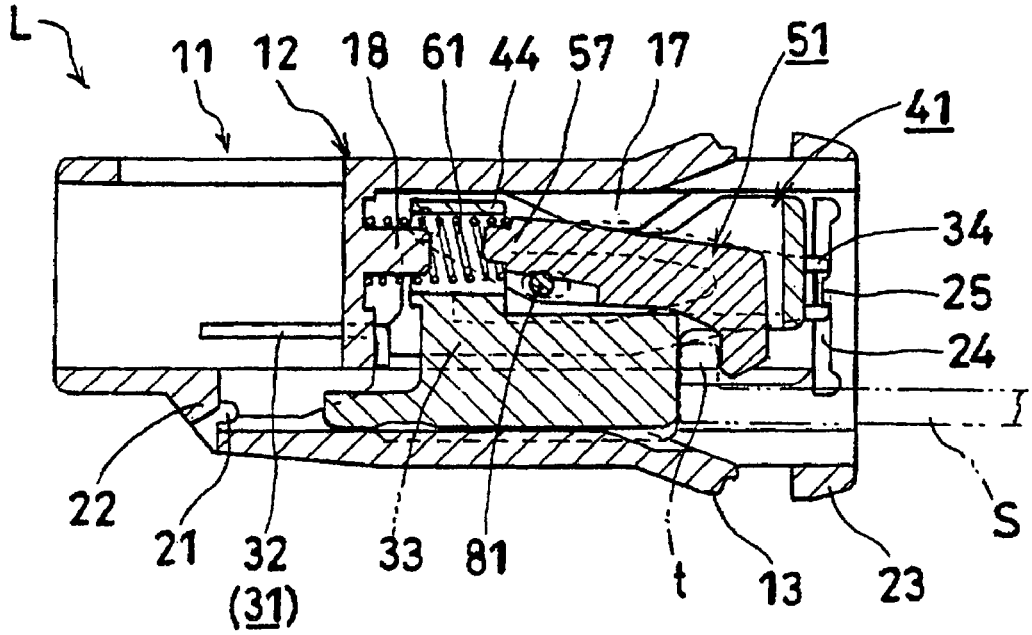
FIG. 27 is an explanatory drawing of the operation of the latch with a switch according to the first embodiment of the invention.
Figure 28:
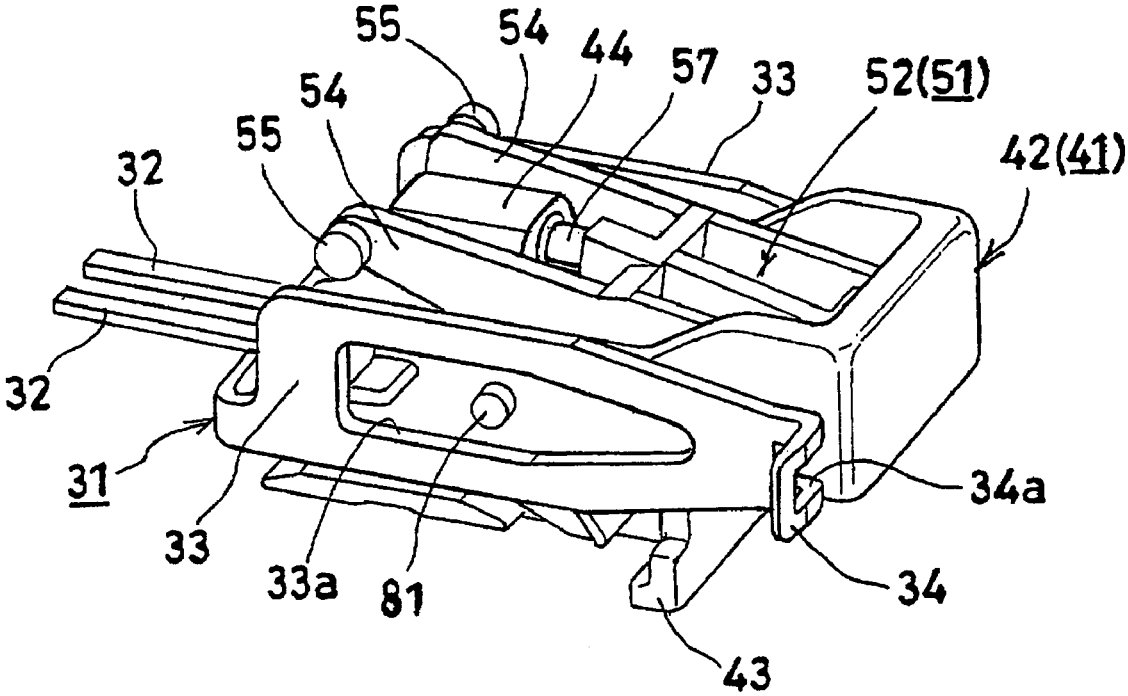
FIG. 28 is an explanatory drawing of the operation of the latch with a switch according to the first embodiment of the invention.

FIGS. 23 to 28 are explanatory drawings of an operation of the latch with a switch according to the first embodiment of the invention. FIG. 23 is an explanatory drawing corresponding to a front sectional view showing mainly an operation of the lock mechanism, FIG. 24 is an explanatory drawing corresponding to a front sectional view showing mainly an operation of the checking member, FIG. 25 is an explanatory drawing showing a state of the switch, FIG. 26 is an explanatory drawing corresponding to a front sectional view showing mainly an operation of the lock mechanism, FIG. 27 is an explanatory drawing corresponding to a front sectional view showing mainly an operation of the checking member, and FIG. 28 is an explanatory drawing showing the state of the switch.

In these drawings, symbol S indicates a striker provided on an opening and closing member such as a door, and a coupling part t is provided on a left end thereof for engaging the checking part 53 of the checking member 51.

Next, an example of an assembly of the latch L with a switch will be explained. First, the left ends of the connection parts 32 of the respective fixed terminals 31 are inserted into the corresponding terminal insertion holes 14 of the housing 11, and the coupling parts 34 of the respective fixed terminals 31 are inserted into the terminal insertion holes 24 of the frame part 23. Accordingly, the checking projections 25 of the frame part 23 enter the coupling holes 34*a* of the respective coupling parts 34 and engage the edges of the coupling holes 34*a*, whereby the pair of fixed terminals 31 is fixed in the opposing insides (inside of the front wall 12*f* and inside of the back wall 12*b*) in the housing 11. In this state, the movable terminal insertion holes 15 of the housing 11 communicate with the terminal holes 33*a* of the fixed terminals 31, and are located at the center in the up-down direction of the terminal holes 33*a*, that is, a position corresponding to a height of the rounded vertex of the triangle of the terminal holes 33*a*.

Also, the checking member 51 is inserted into the open box part 42 of the movable member 41. Next, the spring bearing 18 of the housing 11 is inserted into the left end of the coil spring 61. After the right end side of the coil spring 61 is inserted into the coil spring holding part 44 of the movable member 41, the spring bearing 57 of the checking member 51 is inserted into the right end of this coil spring 61. In this state, when the checking member 51 is held so as not to protrude from the inside of the open box part 42, the movable terminal insertion holes 56 of the checking member 51 become a state of facing the movable terminal insertion holes 47 of the movable member 41.

In the above state, the movable member 41 and the checking member 51 are inserted into the housing 11 while the respective guided parts 43 of the movable member 41 correspond to the guide slots 16 of the housing 11. Also, the movable member 41 and the checking member 51 are inserted into the housing 11, and the movable terminal insertion holes 47 of the movable member 41 and the movable terminal insertion holes 56 of the checking member 51 communicate with the movable terminal insertion through holes 15 of the housing 11. Then, the pin 81 is inserted from one of the movable terminal insertion through holes 15 into the movable terminal insertion hole 47, movable terminal insertion hole 56, movable terminal insertion hole 56, and movable terminal insertion hole 47, so that both ends of the pin 81 do not protrude to the outside of the pair of fixed terminals 31.

In this state, when the force pushing the movable member 41 into the housing 11 is released, the movable member 41 is forced toward the direction of protruding out from the housing 11 by the force of the coil spring 61. The pin 81 contacts the edges of the vertices of the rounded triangles of the terminal holes 33*a* provided on the fixed terminals 31, whereby the movable member 41 is prevented from escaping from the housing 11. Thus, in the state in which the movable member 41 is prevented from escaping from the housing 11 by the pin 81, the pair of trace parts 55 of the checking member 51 connects the flat parts of the cam projections 17 of the housing 11, and the checking part 53 is retracted to the retracted position so as not to engage the coupling part t of the striker S as shown in FIG. 23 and FIG. 24. Also, the pair of fixed terminals 31 becomes conductive by the pin 81, and the switch is turned on as shown in FIG. 25.

Next, the guide lever 71 on the side of the trace parts 74 faces the left side wall 12*l* side of the housing 11, and the respective trace parts 74 are inserted between the first cams 46A and the fourth cams 46D so as to hold the bottom end of the movable member 41 in between. The shaft part 72 is inserted into the recessed part 21. Accordingly, the elastic pressing piece 22 returns to the original state by its own elasticity after the shaft part 72 passes through. The guide lever 71 is attached so as not to come off, and the guide lever 71 becomes capable of rotating inside the recessed part 21, thereby completing the assembly of the latch L with a switch as shown in FIGS. 23 to 25.

Next, an example of an attachment of the latch L with a switch will be explained. First, the left side wall 12*l* side of the box part 12 corresponds to an attachment receiving member, for example, a rotating end of a door of a radio cassette player, and corresponds to an attachment hole of a bracket provided in a main body. Then, the latch L with a switch is inserted and pushed into the attachment hole from the left side wall 12*l* side. Because the respective elastic gripping pieces 13 bend inward by being pressed by the edge of the attachment hole, the box part 12 can be pushed into the attachment hole.

Also, when the frame part 23 contacts one surface of the bracket, because the respective elastic gripping pieces 13 stick out to the back side of the bracket and return to the original state by their own elasticity, the respective elastic gripping pieces 13 engage the edge of the attachment hole in the back side of the bracket. Accordingly, the latch L with a switch is attached to the bracket in a state in which the bracket is held between the elastic gripping pieces 13 and the frame part 23.

Next, the operation of the latch L with a switch will be explained. First, in the assembled state shown in FIG. 23 and FIG. 24, that is, in a state in which the movable member 41 is positioned in the protruding position, both ends of the pin 81 contact the respective fixed terminals 31 through the movable member 41 forced by the force of the coil spring 61 as shown in FIG. 25, whereby the switch is in the on state. In this state, when the right side wall part 42*r* of the movable member 41 is pushed by the striker S and the movable member 41 is pushed into the housing 11 against the force of the coil spring 61, the trace parts 55 of the checking member 51, which are pressed to the flat parts on the lower sides of the cam projections 17 by the force of the coil spring 61, trace the rising surfaces of the cam projections 17, whereby the checking member 51 rotates in the clockwise direction as shown in FIG. 26 and FIG. 27, and advances (descends) to a state in which the checking part 53 is capable of engaging the coupling part t of the striker S.

Also, when the movable member 41 is pushed into the housing 11, the respective trace parts 74 of the guide lever 71 swing so as to trace the lower sides of the corresponding heart cams 45 shown in FIG. 23, and are taken up by the second cam parts 46B, whereby the movable member 41 is pushed in up to the innermost part of the housing 11, and the respective trace parts 74 face the cam surfaces at the front ends (right ends) provided in the heart cam parts 45. In this state, when the force pushing the movable member 41 into the housing 11 is released via the striker S, the movable member 41 is forced toward the direction of protruding from the housing 11 by the coil spring 61. Accordingly, the respective trace parts 74 are guided along the cam surfaces on the front ends of the heart cams 45, and the respective trace parts 74 engage the corresponding cam recessed parts 45*a* as shown in FIG. 26, whereby the lock mechanism becomes the locked state and the movable member 41 is locked in the pushed-in position.

In the process in which the movable member 41 is pushed into the housing 11 from the state shown in FIG. 23 to the state shown in FIG. 26, both ends of the pin 81 move inside the terminal holes 33*a* without contacting the fixed terminals 31. Accordingly, as shown in FIG. 28, in the state in which the movable member 41 is locked in the pushed-in position, both ends of the pin 81 become a non-contact state with the respective fixed terminals 31, and the switch becomes the off state.

In the locked state of the lock mechanism, when the movable member 41 is pushed again into the housing 11 against the force of the coil spring 61 via the striker S, the respective trace parts 74 are guided by the third cams 46C, and the lock mechanism becomes the unlocked state as shown in FIG. 26. Accordingly, in the unlocked state of the lock mechanism, when the force pushing the movable member 41 into the housing 11 is released via the striker S, the movable member 41 is forced toward the direction of protruding from the housing 11 by the force of the coil spring 61, and the movable member 41 returns to the protruding position shown in FIGS. 23 to 25. Thus, in the process in which the movable member 41 returns to the protruding position, the respective trace parts 74 trace the upper sides of the heart cams 45 and then are guided by the fourth cams 46D to return to the original position shown in FIG. 23. Also, the trace parts 55 trace the lower flat parts of the cam projections 17 from the descending surfaces, whereby the checking member 51 rotates in the counter-clockwise direction, and the checking part 53 retreats (ascends) to the state shown in FIG. 24 in which the checking part 53 is not capable of engaging the coupling part t of the striker S. Also, when the movable member 41 returns to the protruding position, both ends of the pin 81 contact the respective fixed terminals 31 through the movable member 41 being forced by the coil spring 61 as shown in FIG. 25, whereby the switch becomes the on state.

As described above, according to the first embodiment of this invention, the switch is formed of the pin 81 (movable terminal) attached to the movable member 41 with both ends protruding from two opposite side surfaces of the movable member 41, and a pair of the fixed terminals 31 fixed oppositely inside the housing 11. When the movable member 41 is in the protruding position, both ends of the pin 81 contact in the conducting state, and when the movable member 41 is in the pushed-in position, both ends of the pin 81 do not contact in the non-conducting state. Accordingly, the pin (movable terminal) 81 can be manufactured inexpensively, whereby the latch L with a switch can be manufactured inexpensively. Also, the pin 81 always is forced by the coil spring 61 toward the direction of protruding from the housing 11, and contacts the fixed terminals 31 in the forced state. Accordingly, poor contact between the pin 81 and the fixed terminals 31 tends not to occur, and the reliability of the switch can be assured.

Also, it is arranged such that the pin 81 is incorporated from the movable terminal insertion through holes 15 provided in the side surfaces of the housing 11. Accordingly, the pin (movable terminal) 81 becomes easier to assemble thereon, and the assembly operation can be performed with good operating characteristics. Furthermore, because the pin 81 is capable of rotating relative to the movable member 41, the pin 81 contacts the pair of fixed terminals 31 at various portions, thereby improving the reliability of the switch. Also, because the pin 81 has the circular cross-section, the fixed terminals 31 contact the pin 81 stably, thereby improving the reliability of the switch. Furthermore, because the pin 81 functions as the rotating shaft of the checking member 41, the number of parts can be made smaller, and the number of assembly steps can be made smaller.

Figure 29:
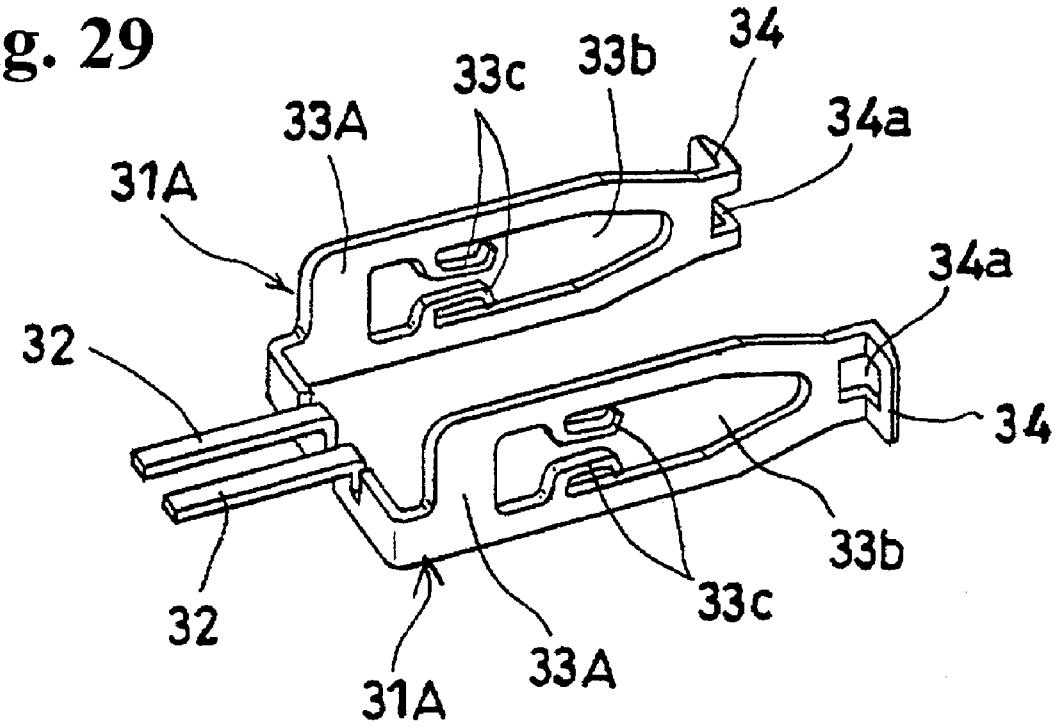
FIG. 29 is a perspective view of fixed terminals constituting a latch with a switch according to a second embodiment of the invention.
Figure 30:
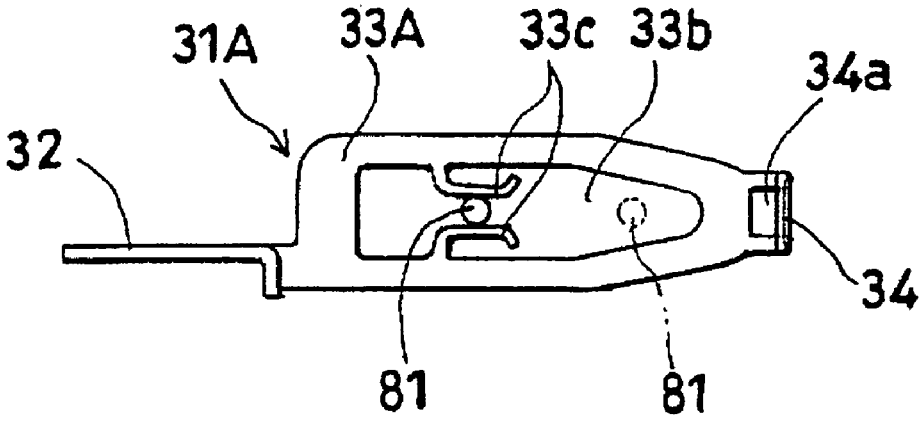
FIG. 30 is a front view of the fixed terminals shown in FIG. 29.

FIG. 29 is a perspective view of fixed terminals constituting a latch with a switch according to a second embodiment of the invention, and FIG. 30 is a front view of the fixed terminals shown in FIG. 29. The same symbols are assigned to the same or comparable parts in FIGS. 1 to 28, and their explanations are omitted. Other constituent parts of the latch with a switch using the fixed terminals are the same as those in the first embodiment except for a part of the housing and a part of the movable member.

In these drawings, reference numeral 31A indicates the fixed terminals formed by pressing a conductive metal flat plate. The fixed terminal is formed of a connection part 32 with a left end part bent at a right angle to protrude out of the housing 11 from the terminal insertion hole 14 of the housing 11; a flat plate part 33A connected to the connection part 32 like a crank; and a coupling part 34 connected to the right end of the flat plate part 33A while being bent at a right angle to be inserted into the terminal insertion hole 24 of the housing 11. Also, on the flat plate part 33A, elastic contact parts 33*c* are provided while facing oppositely in a vertical direction on the same plane as the flat plate part 33A so as to protrude into the coupling terminal hole 33*b* as a cut-out part for contacting and moving away from the pin 81 passing through.

The pair of fixed terminals 31A is formed symmetrically on the plane held between the fixed terminals 31A. Also, in order to prevent escape of the movable member 41 from the housing 11 and make the switch the off (non-conducting) state at the protruding position of the movable member 41, for example, a hole is provided in the housing 11 in the left-right direction, and a guided projection moving inside a guide hole of the housing 11 is provided in the movable member 41. The housing 11 and the movable member 41 are constituted such that, in a state in which the guided projection of the movable member 41 hits against a right edge of the guide hole in the housing 11, the movable member 41 is prevented from escaping from the housing 11, and the pin 81 moves away from the fixed terminals 31 to become the off (non-conducting) state.

An assembly method and attachment method of the second embodiment are the same as those in the first embodiment, and their explanations are omitted. Only operations of the second embodiment different from those in the first embodiment will be explained. As mentioned above, in the state in which the movable member 41 is positioned in the protruding position, as shown with a hidden line in FIG. 30, the pin 81 becomes a non-contact state with the pair of fixed terminals 31A, and the switch becomes the off state. However, when the movable member 41 is pushed into the housing 11 and locked in the pushed-in position, the pin 81 becomes a contact state with the pair of fixed terminals 31A, and the switch becomes the on state as shown with a solid line in FIG. 30.

Accordingly, in the latch L with a switch of the second embodiment, the same effect as in the latch L with a switch of the first embodiment can be obtained.

In the embodiments described above, the examples are shown in which the movable terminal insertion through holes 15 for inserting and incorporating the pin 81 are provided in the opposite side surfaces of the housing 11. However, in a case that there is a possibility that the pin 81 may escape from the movable terminal insertion through holes 15, the movable terminal insertion through holes 15 may have a diameter for the pin 81 to be pressed inside so that the pin 81 is difficult to escape. Alternatively, one of the movable terminal insertion through holes 15 may be omitted to make the pin 81 difficult to escape. Also, the examples are shown in which the coil spring holding part 44 is provided on the movable member 41 to prevent buckling of the spring 61. The coil spring holding part may be formed in a U-shape viewed from the left side without the upper part, and the buckling of the coil spring 61 may be prevented between the coil spring holding part and the top wall 12*u* of the housing 11. Furthermore, the examples are shown in which the striker S engages the rotating checking member 51. It may be also constituted such that opposing gripping pieces are provided at the right ends of the movable member through a hinge. When the movable member is pushed into the housing, the gripping pieces are pushed inwardly in the housing and rotate around the hinge part toward a direction of approaching each other to grip the striker. In this case, it is desirable that the movable terminal insertion holes 47 have a diameter such that the pin 81 can rotate.

The latch with a switch of the invention has been explained with the examples attached to a radio cassette player. It can be applied also to other machines having an opening and closing door, and machines having a moving body moving between a pushed-in position and a protruding position such as an ashtray and small compartment in an automobile, or a home appliance.

The disclosure of Japanese Patent Application No. 2003-360524, filed on Oct. 21, 2003, is incorporated in the application.

While the invention has been explained with reference to the specific embodiments of the invention, the explanation is illustrative and the invention is limited only by the appended claims.

What is claimed is:

1. A latch with a switch, comprising:

a housing having an opening, a movable member movably disposed in the housing, and having a portion to be able to protrude outside the housing through the opening, a forcing member disposed in the housing for urging the movable member to protrude outside the housing, a locking member disposed between the housing and the movable member for locking the movable member at a lock position against a force of the forcing member, and a switch disposed in the housing for performing a switching operation and formed of a movable terminal having a pin attached to the movable member, said pin having two ends protruding outwardly from two side surfaces of the movable member and located inside the housing, and a pair of fixed terminals attached inside the housing for contacting with or separating from the movable terminal according to movements of the movable member, said fixed terminals being affixed to inner surfaces facing each other in the housing, wherein said housing further includes a movable terminal insertion hole formed in at least one of the two opposing inner surfaces for inserting the pin of the movable terminal.

2. A latch with a switch according to claim 1, wherein said movable terminal is arranged to be rotatable relative to the movable member.

3. A latch with a switch according to claim 2, wherein said movable terminal has a circular cross section.

4. A latch with a switch comprising:

a housing having an opening, a movable member movably disposed in the housing, and having a portion to be able to protrude outside the housing through the opening, a forcing member disposed in the housing for urging the movable member to protrude outside the housing, a locking member disposed between the housing and the movable member for locking the movable member at a lock position against a force of the forcing member, and a switch disposed in the housing for performing a switching operation and formed of a movable terminal having a pin attached to the movable member, said pin having two ends protruding outwardly from two side surfaces of the movable member and located inside the housing, and a pair of fixed terminals attached inside the housing for contacting with or separating from the movable terminal according to movements of the movable member, said fixed terminals being affixed to inner surfaces facing each other in the housing, wherein each of said fixed terminals includes a terminal hole having an end portion, said pin being located in the terminal hole to be able to contact with the end portion or separate therefrom.

5. A latch with a switch according to claim 1, wherein said locking member is arranged such that when the movable member is pushed into the housing against the force of the forcing member, the locking member locks the movable member at the lock position, and when the movable member at the lock position is pushed again into the housing against the force of the forcing member, the locking member releases the movable member from the lock position.

6. A latch with a switch according to claim 5, wherein said switch is arranged such that when the movable member is locked at the lock position, the switch becomes one of an on state and an off state, and when the movable member is released from the lock position, the switch becomes the other of the on state and the off state.

* * * * *